US006491032B1

(12) United States Patent
Kanno

(10) Patent No.: US 6,491,032 B1
(45) Date of Patent: Dec. 10, 2002

(54) MARINE ENGINE CONTROL SYSTEM

(75) Inventor: Isao Kanno, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/708,900

(22) Filed: Nov. 8, 2000

(30) Foreign Application Priority Data

Nov. 12, 1999 (JP) ..... 11-323335

(51) Int. Cl.[7] ..... F02D 41/00
(52) U.S. Cl. ..... 123/680; 123/436
(58) Field of Search ..... 123/680, 683, 123/684, 436, 339.1, 339.12, 339.23, 486, 478, 480; 701/104

(56) References Cited

U.S. PATENT DOCUMENTS

| | | | | |
|---|---|---|---|---|
| 4,858,136 A | * | 8/1989 | Tanaka et al. | 364/431.07 |
| 4,907,556 A | * | 3/1990 | Ishii et al. | 123/486 |
| 5,603,301 A | | 2/1997 | Sakurai et al. | |
| 5,615,661 A | | 4/1997 | Suzuki | |
| 5,623,904 A | | 4/1997 | Matsumoto | |
| 5,626,120 A | | 5/1997 | Akatsuka | |
| 5,687,700 A | | 11/1997 | Kato | |
| 5,715,794 A | | 2/1998 | Nakamura et al. | |
| 5,738,074 A | | 4/1998 | Nakamura et al. | |
| 5,769,060 A | | 6/1998 | Matsumoto | |
| 5,778,857 A | | 7/1998 | Nakamura et al. | |
| 5,794,605 A | | 8/1998 | Kato | |
| 5,868,118 A | * | 2/1999 | Yoshioka | 123/494 |
| 5,918,584 A | | 7/1999 | Kato | |
| 5,937,825 A | | 8/1999 | Motose | |
| 5,941,223 A | | 8/1999 | Kato | |
| 6,030,261 A | | 2/2000 | Motose | |
| 6,082,334 A | * | 7/2000 | Shomura et al. | 123/478 |
| 6,098,591 A | | 8/2000 | Iwata | |
| 6,119,653 A | * | 9/2000 | Morikami | 123/339.23 |
| 6,227,172 B1 | | 5/2001 | Katayama et al. | |
| 6,286,472 B1 | | 9/2001 | Takahashi et al. | |
| 6,286,492 B1 | * | 9/2001 | Kanno | 123/684 |
| 6,321,720 B1 | | 11/2001 | Kashima | |
| 6,367,448 B1 | | 4/2002 | Sugiyama et al. | |
| 6,375,525 B1 | | 4/2002 | Kanno | |

FOREIGN PATENT DOCUMENTS

| | | |
|---|---|---|
| EP | 0 575 939 B1 | 6/1993 |
| EP | 0 972 919 A2 | 7/1999 |
| EP | 0 997 631 A1 | 10/1999 |
| EP | 1 001 160 A3 | 11/1999 |

* cited by examiner

*Primary Examiner*—Willis R. Wolfe
*Assistant Examiner*—Mahmoud Gimie
(74) *Attorney, Agent, or Firm*—Knobbe, Martens, Olson & Bear LLP

(57) ABSTRACT

An outboard motor comprises an engine mounted within an engine compartment. The engine comprises an induction system having an induction passage extending between a plenum chamber and a combustion chamber. A throttle valve is positioned along the passage. A bypass passage communicates with the passage at a location between the throttle valve and the combustion chamber. An adjustable valve controls flow through the bypass passage. The adjustable valve can be moved below a first preset throttle angle position and fixed above that preset throttle angle. The engine further comprises a fuel injector. The fuel injection amount is controlled by more than one control map. The control maps determine a fuel injection amount based on at least two sensed engine conditions. Based on throttle angle position, the control scheme determines which control map is used.

17 Claims, 6 Drawing Sheets

Increasing ↑

Engine Speed

| | | | | |
|---|---|---|---|---|
| C1 | A11 | — — — | — — — | Am1 |
| C2 | A12 | | | ⋮ |
| ⋮ | ⋮ | | | ⋮ |
| ⋮ | ⋮ | | | ⋮ |
| ⋮ | ⋮ | | | ⋮ |
| Cn | A1n | — — — | — — — | Amn |
| | K1 | — — — | — — — | Km |

Throttle Opening Degree → Increasing

*Figure 5*

MARINE ENGINE CONTROL SYSTEM

PRIORITY INFORMATION

This application is based on and claims priority to Japanese Patent Application No. Hei 11-323335, filed Nov. 12, 1999, the entire contents of which is hereby expressly incorporated by reference.

BACKGROUND OF THE INVENTION

1. Field of the Invention

This invention generally relates to a control system for an internal combustion engine. More particularly, this invention relates to an apparatus and method for controlling fuel injection amount and idle speed of a marine engine.

2. Description of the Related Art

Outboard motors are powered by engines contained within an engine compartment of the outboard motor. The outboard motors are conventionally attached to watercraft to power the watercraft in a forward or reverse direction. As is known, the engine of a marine craft is subject to increased loading when compared to that of an automobile, for instance. This increased loading generally results from the nature of the marine craft drive system and the environment in which the marine craft is used.

The engines that power the outboard motors may contain an intake system featuring a bypass passage. The bypass passage typically is linked to the intake system upstream and downstream of a throttle control valve. As is known, the throttle control valve controls the amount of air flowing through the induction system into the engine for combustion. When the throttle control valve is closed, the air flow rate is minimized and when the throttle control valve is opened, the flow rate through the induction system can be somewhat controlled. The use of a bypass passage allows air to bypass the throttle control valve for supply to the engine even when the throttle control valve is closed. In some instances, an ISC, or idle speed control valve, is positioned along the bypass passage. The ISC valve can be used to fine tune the idling engine speed when the throttle control valve is in a closed position.

Conventional ISC valves are designed to open when the throttle valve suddenly closes following a period of high speed operation. It is thought that by opening the ISC valves when the throttle valve closes, misfiring and stalling can be obviated or greatly reduced. Generally speaking, the ISC valves are closed when the throttle valve is opened and when the engine speed is low. The ISC valves are then opened when the throttle valve is closed and when the engine speed is high. In some applications, the ISC valves can be suddenly opened during high speed operation of the engine and then gradually closed after the engine speed decreases below a preset level.

The positioning of the idle speed control valve often is controlled by inexpensive step motors. The inexpensive step motors typically have a slow response characteristic. In other words, the command to move is followed by a slight delay before the movement occurs. Because of the resulting slow opening rate of the idle speed control valve, the air flow through the induction system typically does not properly match the desired change of the engine speed resulting from the rapid change in a throttle opening position. Accordingly, the engine can stall or misfire due to an inadequate supply of intake air. One way of correcting this is to provide an idle speed control valve in which the ISC valve opens more rapidly for each input signal to the stepper motor. A drawback from this approach is that a large ISC valve is required and the larger ISC valves increase cost and weight.

Another solution to the misfiring and stalling of the engine is to make the ISC valve more accurately follow the changes in a throttle angle and consequently the engine speed. Preferably, this arrangement would result in the ISC valve being maintained in an open position while the throttle angle is open. This arrangement ensures that a more-than-adequate air supply is provided when the throttle angle is rapidly decreased. The ISC valve then can close with the throttle valve.

In some arrangements, a controller determines the proper amount of fuel to be injected by observing one or more operating condition of the engine. For example, the engine speed and the intake air pressure (indicating the amount of air being introduced by the intake air passage) conventionally are used. Controllers typically are given an optimized fuel injection amount based on each operational engine speed and intake air pressure. Another similar method is to control the fuel injection amount based on engine speed and throttle angle opening. Both of the methods have their own disadvantages.

Fuel injection control based at least in part on intake pressure is particularly problematic during transition from small throttle angle opening to large throttle angle opening. During this transition, the amount of air being introduced into the combustion chamber is difficult to measure. This is because typical intake pressure sensors observe pressure wave troughs to determine pressure in the intake air passage. As throttle opening increases, the pressure oscillation frequency increases until adjacent pressure waves are superimposed and begin to cancel. Therefore, the controllers receive inaccurate air pressure information and output non-optimal fuel injection amounts.

Fuel injection amounts based on throttle opening are also non-optimal because, in the transitional region, the air contribution through the bypass passage is not always properly accounted for. For instance, although the ISC valve is open it may not be fixed in an open position. This can result in unpredictable introduction of air through the bypass passage. This problem becomes even more pronounced when the engine speed is low (throttle valve closing). In that state, the amount of air introduced through the bypass passage as a percentage of total air introduced into the combustion chamber is relatively large.

SUMMARY OF THE INVENTION

Accordingly, an arrangement is desired in which the ISC valve is substantially fixed when the throttle valve has an angle above a preset value. An arrangement is also desired in which the fuel injection amount is accurately determined based on intake air pressure, engine speed and throttle angle position, depending on operational ranges of the engine. For instance, a control strategy referencing intake pressure and engine speed can be used below a preset throttle opening while a control strategy referencing throttle valve position and engine speed can be used above the preset throttle angle.

Thus, one aspect of the present invention involves providing a control system whereby the position of the ISC valve is substantially fixed above a preset value and the fuel injection amount inputted to the fuel injectors is a function of the air intake pressure, the engine speed and the throttle valve opening.

A further aspect of the present invention involves a marine engine for a watercraft comprises a cylinder block.

At least one bore is formed in the cylinder body. A piston is mounted for reciprocation within the cylinder bore. A cylinder head assembly is disposed over a first end of the cylinder bore forming a combustion chamber with the piston and cylinder bore. A journaled crankshaft is drivingly connected to the piston by a connecting rod. An intake air passage is in fluid communication with the combustion chamber at one end and in fluid communication with a plenum chamber at the other. An intake valve positioned between the intake air passage and the combustion chamber allows for timed introduction of the air/fuel mixture. A throttle valve is pivotally mounted in the air intake passage for defining the amount of air flowing in the air intake passage. A fuel injector for forming the air/fuel mixture is connected to the air intake passage at a point downstream from the throttle valve. A bypass passage is in fluid communication with the plenum chamber and the air intake passage downstream from the throttle valves. An ISC valve pivotally mounted in the bypass passage is driven by an actuator for determining the amount of air flowing in the bypass passage. An angle position sensor juxtaposed with the crankshaft signals engine speed to an ECU. A intake pressure sensor signals intake air pressure downstream of the throttle valve to the ECU. A throttle valve position sensor connected to the throttle valve sends signals throttle valve opening to ECU. The ECU, using at least two signal inputs determines fuel injection amount and signals that fuel injection amount to the fuel injector(s). The ECU, using at least one signal input, determines the correct position for the ISC valve, and communicates that value to an actuator. The actuator drives the ICS valve to the correct position.

Another aspect of the present invention involves a method of operating a internal combustion marine engine. The method comprises the steps of (a) sensing at least one running condition of the engine, (b) comparing the at least one running condition to a preset value, (c) determining a target ISC valve opening if the at least one running condition is greater than the preset value, (d) sensing the current ISC valve opening, comparing the target ISC valve opening with the current ISC value, (e) driving the ISC valve with the stepper motor if the sensed ISC valve opening is not about equal to the target ISC valve opening, and (f) continuing the steps (a)–(e) while the engine is running.

A further aspect of the present invention involves a method of controlling an idle speed control valve in a marine engine for a watercraft. The method involves sensing throttle position and moving the ISC valve if the throttle position is less than a first preset value. If the throttle position is greater than the first preset value, the method involves substantially fixing the ISC valve at a fully open position. The method also involves sensing engine speed, intake pressure and throttle angle opening. Below the first preset throttle angle, the method involves determining the fuel injection amount based on engine speed and intake air pressure. Above a second preset throttle angle, the method involves determining the fuel injection amount based on the engine speed and the throttle position. Between the first and the second preset throttle angles, the method involves determining the fuel injection amount based on both the engine speed, the intake air pressure and the throttle angle.

BRIEF DESCRIPTION OF THE DRAWINGS

These and other features, aspects and advantages of the present invention will now be described with reference to the drawings of a preferred embodiment, which is intended to illustrate and not to limit the invention. The drawings comprise six figures.

FIG. 5 is an exemplary fuel injection control map for larger throttle valve angles.

DETAILED DESCRIPTION OF THE PREFERRED EMBODIMENT

Figure 1:
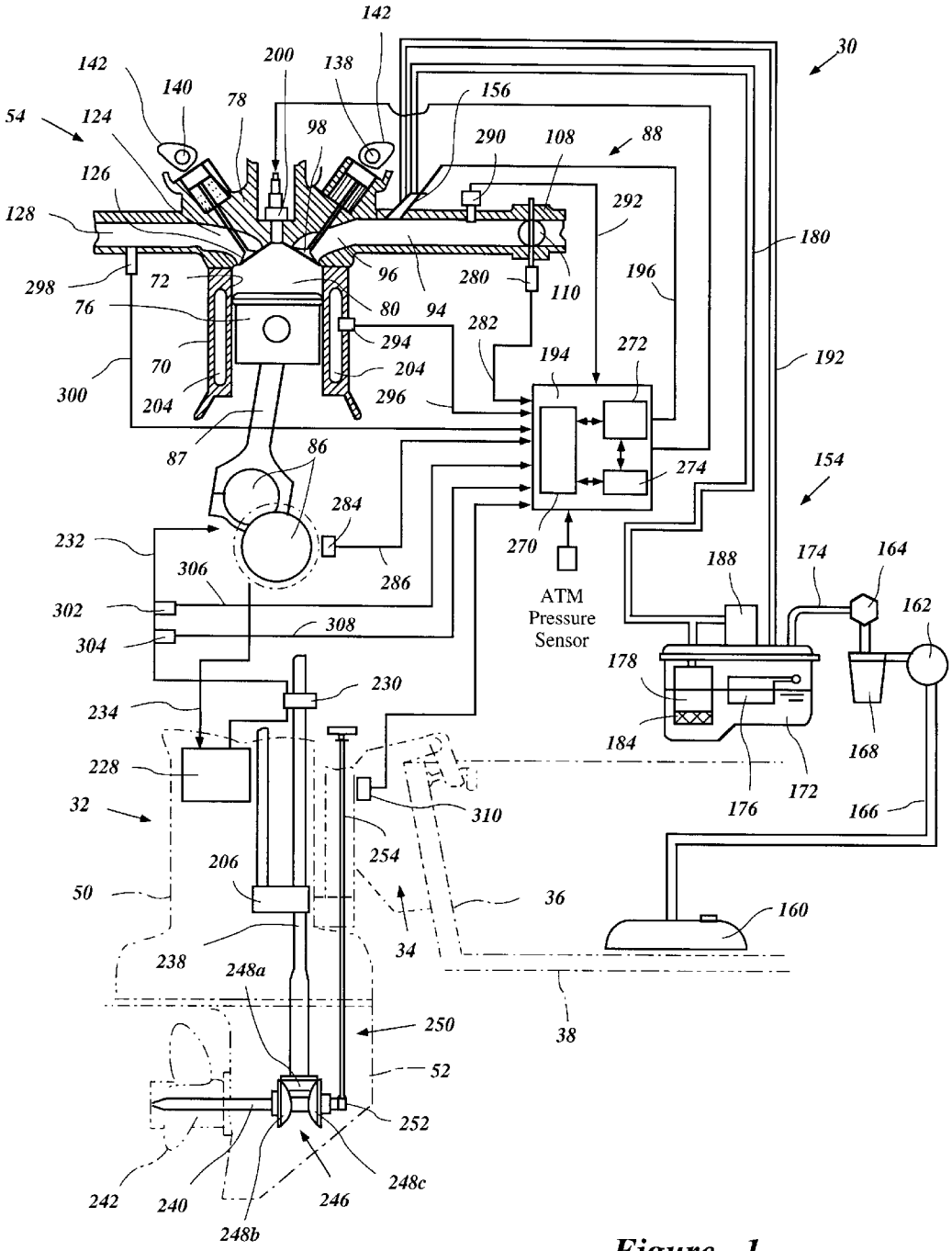
FIG. 1 is a schematic view of an outboard motor. A portion of the engine is generally shown in the upper portion of the figure. A portion of the outboard motor including a drive shaft housing and a lower unit and the associated watercraft are shown in the lower portion of the figure. An ECU and a fuel injection system link together the two portions of the figure. The lower portion of the outboard motor and the watercraft are generally shown in phantom.
Figure 2:
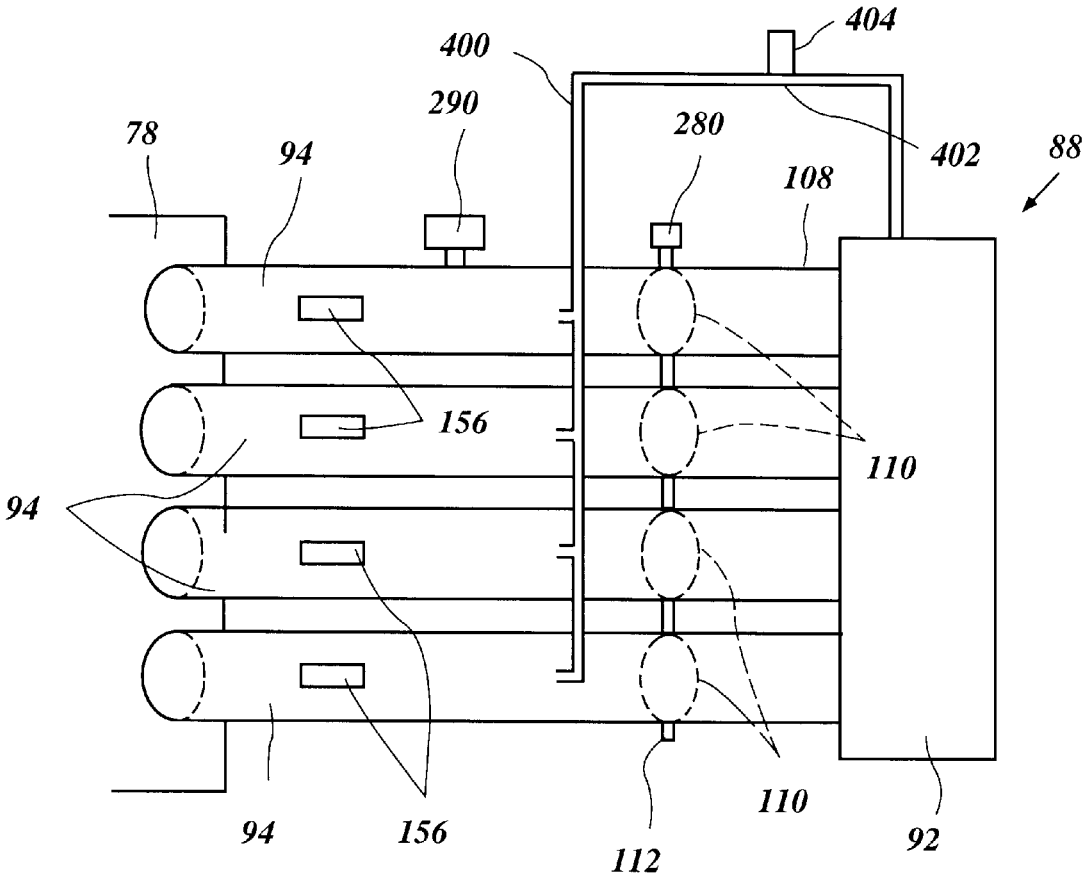
FIG. 2 is a schematic view of at least a portion of an air induction system that is associated with the engine of FIG. 1.

With reference now to FIGS. 1 and 2, an overall construction of an outboard motor 30, which employs a control system arranged and configured in accordance with certain features, aspects and advantages of the present invention, will be described. Although the present invention is shown in the context of an outboard motor engine, various features, aspects and advantages of the present invention also can be employed with engines used in other types of marine drives (e.g., a stern drive unit and inboard/outboard drives) and also, for example, with engines used in land vehicles (i.e., motorcycles, snowmobiles and all terrain vehicles) and stationary engines (i.e., generators).

In the illustrated arrangement, the outboard motor 30 comprises a drive unit 32 and a bracket assembly 34. The bracket assembly 34 supports the drive unit 32 on a transom 36 of an associated watercraft 38. The drive unit 32 preferably is disposed such that a marine propulsion device is placed in a submerged position with the watercraft 38 resting on the surface of a body of water.

As used through this description, the terms "forward," "forwardly" and "front" mean at or to the side where the bracket assembly 34 is located, and the terms "rear," "reverse," "backwardly" and "rearwardly" mean at or to the opposite side of the front side, unless indicated otherwise or otherwise readily apparent from the context use.

The illustrated drive unit 32 includes a power head (not shown), a driveshaft housing 50 and a lower unit 52. The power head is disposed atop the drive unit 32 and includes an internal combustion engine 54, which is positioned within a protective cowling (not shown).

The engine 54 preferably operates on a four-stroke combustion principle. The illustrated engine 54 comprises a cylinder block 70 that defines four cylinder bores 72. The cylinder bores 72 are generally horizontally extending and are vertically spaced from one another. This type of engine, however, is exemplary of an engine on which various features, aspects and advantages of the present invention can be used. Engines having other number of cylinder bores, having other cylinder arrangements and operating on other combustion principles (e.g., two-stroke crankcase combustion or rotary) all can use at least some of the features, aspects or advantages described herein.

A piston 76 can reciprocate in each cylinder bore 72. In the illustrated arrangement, a cylinder head assembly 78 is affixed to one end of the cylinder block 70 and, together with the pistons 76 and the cylinder bores 72, defines four combustion chambers 80. A crankcase member (not shown) preferably closes the other end of the cylinder block 70. Together, the cylinder block 70 and the crankcase member at least partially define a crankcase chamber (not shown). A crankshaft 86 extends generally vertically through the crankcase chamber. The crankshaft 86 preferably is connected to the pistons 76 by connecting rods 98 and is rotated by the reciprocal movement of the pistons 76. In the illustrated arrangement, the crankcase member (not shown) is located at the most forward position with the cylinder block 70 and the cylinder head assembly 78 extends rearward from the crankcase member. These components preferably are mounted in seriatim.

The engine 54 includes an air induction system 88 through which air is introduced into the combustion chambers 80. The induction system 88 preferably includes a plenum chamber 92, four air intake passages 94 and eight intake ports 96. As will be recognized, the number of intake passages and ports can vary. The intake ports 96 are defined in the cylinder head assembly 78. In the illustrated arrangement, two of the intake ports 96 are associated with a single intake passage 94 and both of the intake ports 96 open into a single combustion chamber 80.

The intake ports 96 are repeatedly opened and closed by intake valves 97. When intake ports 96 are opened, the respective intake passages 94 communicate with the associated combustion chambers 80.

The illustrated intake passages 94 are defined by intake ducts (not shown), which are preferably formed with the plenum chamber member (not shown), intake manifolds (not shown) connected to the associated intake ports 96 and throttle bodies 108 interposed between the intake ducts (not shown) and the intake manifolds (not shown). In the illustrated arrangement, the respective throttle bodies 108 support butterfly-type throttle valves 110 in a manner that allows pivotal movement of the valves 110 about axes defined by valve shafts that extend generally vertically. The valve shafts preferably are linked together to form a single valve shaft assembly 112 that passes through all of the throttle bodies 108.

The throttle valves 110, thus, admit a proper amount of air into the intake passages 94 in proportion to an opening degree or opening position thereof. In other words, a certain amount of air measured by the throttle valves 110 is introduced into the combustion chambers 80 through the intake passages 94. Under a normal running condition, the larger the amount of the air, the higher the speed of the engine operation. When the throttle valves 110 are in a generally closed position, the opening degree at this position is defined as zero degrees. The throttle valves 110 preferably do not completely close, even in the zero position, and movement of the throttle valves 110 preferably stops at approximately one degree to allow a small amount of air to flow passed. This amount of air can keep the engine operational in an idle state. In addition, small holes can be formed in the throttle valve 110 or a bypass passage can be arranged to allow a small level of air flow even if the throttle valves are completely closed.

In the illustrated arrangement, a bypass passage 400 is provided between or the plenum chamber 92 and the air intake passages 94 extending to the cylinder head assembly 78. The bypass passage 400 is designed to communicate with each of the illustrated air intake passages 94. The bypass passage 400 opens into the air intake passages 94 downstream of the throttle control valves 110 such that when the throttle control valves 110 are closed, air may be supplied to the air intake passages 94 through the bypass passage 400 under the control of an ISC valve 402. In some arrangements, multiple valves 402 can be provided to correspond with the air intake passages 94. The ISC valve 402 can be opened and closed to vary the level of flow through the associated bypass passage 400.

The ISC valve 402 can be moved using an actuator 404 associated with the valve 402, which will be described in more detail below. In the illustrated arrangement, the actuator 404 comprises a stepper motor. In some configurations, however, the actuator 404 may comprise a solenoid or other suitable actuator mechanism. In the illustrated arrangement, the actuator 404 is in electrical communication with the ECU 194 to receive signals from the ECU 194 that are generated in accordance with certain features, aspects and advantages of the present invention. The electrical connection between the ECU and the actuator 404 is provided by control signal line 406 in the illustrated arrangement. Of course, other electrical connections can be used, including, but not limited to, infrared, radio waves, emitter and detector pairs and the like. Because the actuator 404 directly connects to the ISC valve 402, the angular position of the actuator determines the angular opening of the ISC valve 402, and thus the amount of air supplied through the bypass passage 400 to the combustion chamber 80. Control strategies relating to the air induction system will be described in more detail below.

The engine 54 also preferably includes an exhaust system that directs burnt air-fuel charges or exhaust gases to a location outside of the outboard motor 30. A set of exhaust ports 124 are defined in the cylinder head assembly 78 and are repeatedly opened and closed by a corresponding set of exhaust valves 126. When the exhaust ports 124 are opened, the combustion chambers 80 communicate with an exhaust manifold (not shown) that collects the exhaust gases and directs them away from the combustion chambers 80. The exhaust gases, in major part, are discharged into the body of water surrounding the outboard motor 30 through any suitable exhaust system.

An intake camshaft 138 and an exhaust camshaft 140 are journaled for rotation and extend generally vertically in the cylinder head assembly 78. The intake camshaft 138 actuates the intake valves 97 while the exhaust camshaft 140 actuates the exhaust valves 126. The camshafts 138, 140 have cam lobes 142 thereon to push the respective valves 97, 126. The associated ports 96, 124 are thus opened and closed repeatedly.

Preferably, the crankshaft 86 drives the camshafts 138, 140. Each camshaft 138, 140 has a sprocket (not shown), while the crankshaft 86 also has a sprocket (not shown). A timing belt or chain (not shown) is wound around the respective sprockets. The crankshaft 86 therefore drives the camshafts 138, 140.

The illustrated engine 54 further includes a fuel injection system 154. The fuel injection system 154 preferably employs four fuel injectors 156 with one fuel injector allotted for each of the respective combustion chambers 80. In the illustrated arrangement, each fuel injector 156 has an injection nozzle that is exposed to the associated intake passage 94 such that the illustrated engine is indirectly injected. Of course, the engine can be directly injected in some arrangements.

The injection nozzle preferably is opened and closed by an electromagnetic unit, such as a solenoid, which is slideable within an injection body. The electromagnetic unit generally comprises a solenoid coil, which is controlled by electrical signals. When the nozzle is opened, pressurized fuel is released from the fuel injectors 156. The illustrated fuel injectors 156 thus spray the fuel into the intake passages 94 during an open timing of the ports 96. The sprayed fuel enters the combustion chambers 80 with air that passes through the intake passages 94.

The fuel injection system 154 includes a fuel supply tank 160 that preferably is placed in the hull of the associated watercraft. In the illustrated arrangement, fuel is drawn from the fuel tank 160 by a first low pressure fuel pump 162 and a second low pressure pump 164 through a first fuel supply conduit 166. The first low pressure pump 162 preferably is a manually operated pump. The second low pressure pump 164 preferably is a diaphragm-type pump that can be operated by, for example, one of the intake and exhaust camshafts 138, 142. In this instance, the second low pressure pump 164 is mounted on the cylinder head assembly 78. A quick disconnect coupling can be provided in the first conduit 166. Also, a fuel filter 168 can be positioned in the conduit 166 at an appropriate location.

From the low pressure pump 164, fuel is supplied to a vapor separator 172 through a second fuel supply conduit 174. In the illustrated embodiment, the vapor separator 172 is mounted on the intake manifold (not shown). At the vapor separator end of the conduit 174, a float valve can be provided that is operated by a float 176 to maintain a substantially uniform level of the fuel contained in the vapor separator 172.

A high pressure fuel pump 178 is provided in the vapor separator 172. The high pressure fuel pump 178 pressurizes fuel that then is delivered to the fuel injectors 156 through a delivery conduit 180. A fuel rail (not shown) defines a portion of the delivery conduit 180 and is mounted on the cylinder head assembly 78. The fuel rail preferably supports the fuel injectors 156. The high pressure fuel pump 178 in the illustrated embodiment preferably comprises a positive displacement pump. The construction of the pump 178 thus generally inhibits fuel flow from its upstream side back into the vapor separator 172 when the pump 178 is not running. Although not illustrated, a back-flow prevention device (e.g., a check valve) also can be used to prevent a flow of fuel from the delivery conduit 180 back into the vapor separator 172 when the pump 178 is off. This later approach can be used with a fuel pump that employs a rotary impeller to inhibit a drop in pressure within the delivery conduit 180 when the pump 178 is intermittently stopped.

The high pressure fuel pump 178 is driven by a fuel pump drive motor 184 which, in the illustrated arrangement, is electrically operable and is unified with the pump 178 at its bottom portion. The drive motor 184 desirably is positioned in the vapor separator 172.

A pressure regulator 188 can be positioned along the fuel delivery conduit 180 at the vapor separator 172 and preferably limits the pressure that is delivered to the fuel injectors 156 by dumping excess fuel back into the vapor separator 172.

A fuel return conduit 192 also is provided between the fuel injectors 156 and the vapor separator 126. Excess fuel that is not injected by the injector 156 returns to the vapor separator 126 through the return conduit 192.

A desired amount of the fuel is sprayed into the intake passages 94 through the injection nozzles at a selected timing for a selected duration. The injection timing and duration preferably are controlled by an ECU 194 through a control signal line 196. That is, the solenoid coil is supplied with electric power at the selected timing and for the selected duration. Because the pressure regulator 188 controls the fuel pressure, the duration can be used to determine a selected amount of fuel that will be supplied to the combustion chambers 80. Control strategies relating to the fuel injection system will be described in more detail below.

The engine 54 further includes an ignition or firing system. Each combustion chamber 80 is provided with a spark plug 200 that is connected to the ECU 194. The spark plug 200 is exposed into the associated combustion chamber 80 and ignites an air/fuel charge at a selected ignition timing. Although not shown, the ignition system preferably has an ignition coil and an igniter which are disposed between the spark plugs 200 and the ECU 194 so that an ignition timing also can be controlled by the ECU 194. In order to enhance or maintain engine performance, the ignition timing can be advanced or delayed in response to various engine running conditions.

The ignition coil preferably is a combination of a primary coil element and a secondary coil element that are wound around a common core. Desirably, the secondary coil element is connected to the spark plugs 200 while the primary coil element is connected to the igniter. Also, the primary coil element is coupled with a power source and electrical current flows therethrough. The igniter abruptly cuts off the current flow in response to an ignition timing control signal and then a high voltage current flow occurs in the secondary coil element. The high voltage current flow forms a spark at each spark plug 200.

During engine operation, heat builds in, for example, the cylinder block 70 and the cylinder head assembly 78. Water jackets 204 thus are provided for cooling at least these portions 70, 78. Cooling water is introduced into the water jackets 204 by a water pump 206 from the body of water surrounding the outboard motor 30 and is returned to the body of water after circulating through the cooling jackets. Thus, the engine 54 employs an open loop type cooling system.

The engine 54 still further includes a lubrication system, which is rather schematically shown in FIG. 1, for lubricating certain portions of the engine 54 such as, for example, the interfaces between the connecting rods 98 and the crankshaft 86 and between the connecting rods 98 and the pistons 76. A lubricant reservoir 228 is disposed atop the driveshaft housing 50. Lubricant in the reservoir 228 is withdrawn by a lubricant pump 230 and then is delivered to the portions which need lubrication through a lubricant supply line 232. After lubricating the portions, the lubricant returns to the lubricant reservoir 228 through a lubricant return line 234 and which then repeats this circulation path. That is, the lubrication system preferably is formed as a closed loop.

The driveshaft housing 50 depends from the power head (not shown) and supports a driveshaft 238 which is driven by the crankshaft 86. The driveshaft 238 extends generally vertically through the driveshaft housing 50. The driveshaft 238 preferably drives the water pump 206 and the lubricant pump 230. As described above, the driveshaft housing 50 also defines internal passages which form portions of the exhaust system.

The lower unit 52 depends from the driveshaft housing 50 and supports a propulsion shaft 240, which is driven by the driveshaft 238. The propulsion shaft 240 extends generally horizontally through the lower unit 52. In the illustrated arrangement, the propulsion device is a propeller 242 that is affixed to an outer end of the propulsion shaft 240 and is driven thereby. The propulsion device, however, can take the form of a dual counter-rotating system, a hydrodynamic jet, or any of a number of other suitable propulsion devices.

A transmission (not shown) is provided between the driveshaft 238 and the propulsion shaft 240. The transmission couples together the two shafts 238, 240 which lie generally normal to each other (i.e., at a 90° shaft angle) with bevel gears 248*a*, 248*b*, 248*c*. The outboard motor 30 has a switchover or clutch mechanism 250 that allows the transmission to shift the rotational direction of the propeller 242 among forward, neutral or reverse.

In the illustrated arrangement, the switchover mechanism 250 includes a shift cam 252, a shift rod 254 and a shift cable (not shown). The shift rod 254 extends generally vertically through the driveshaft housing 50 and the lower unit 52. The shift cable extends through the bottom cowling member (not shown) and then forwardly to a manipulator which is located next to a dashboard in the associated watercraft 38. The manipulator has a shift lever which is operable by the watercraft operator.

With reference now to FIG. 1, the ECU 194 preferably comprises a CPU (central processing unit) chip 270, memory or storage chips 272 and a timer or clock chip 274 which are electrically coupled together within a water-tight, hard box or container. The respective chips preferably are formed as an LSI (large scaled integrated circuit) and can be produced in a conventional manner. The timer chip 274 can be unified with the CPU chip. The memory chips 272 preferably include ROM (read only memory), RAM (random access memory) and EEPROM (electrical erasable programmable ROM).

The ROM is a non-volatile memory and stores the most basic control programs that will not be erased by the watercraft operator. The programs include various control routines, such as those discussed below.

The RAM is a volatile memory and stores programs and data that are erasable and rewriteable. The RAM preferably stores at least two control maps, which can be three-dimensional in some arrangements. The first control map has a horizontal axis designating intake air pressure (Qm), a vertical axis designating engine speed (Cn) and squares designating amount of fuel (Bmn) corresponding to both the intake air pressure and the engine speed. The respective fuel amounts can be determined for a first range of throttle opening to provide an optimal air/fuel ratio in any combination of intake air pressure (Qm) and engine speed (Cn) below a first specified throttle angle. The second control map preferably has a horizontal axis designating throttle opening degrees (Km), a vertical axis designating engine speeds (Cn) and squares designating amounts of fuel (Amn) corresponding to both the throttle opening degrees and the engine speeds. The respective fuel amounts can be determined for a second range of throttle opening to provide an optimal air/fuel ratio in any combination of the throttle opening (Km) and the engine speed (Cn) above a second specified throttle angle. The RAM also preferably stores the relationship between the amount suggested by the first control map and the second control map in the range between the first range of throttle openings and the second range of throttle openings. Of course, less than optimal numbers can be used, where desired. The RAM further stores an engine speed data that is used for determining whether the engine 54 has started. The ECU 194 preferably determines that the engine 54 has started when the engine speed reaches about 300 rpm.

The EEPROM is a non-volatile memory that the operator can erase programs and data stored therein, at least in part, and can rewrite them as he or she desires. In the illustrated arrangement, the EEPROM preferably stores an intake pressure as an atmospheric pressure at which the ECU 194 has been turned on while the engine 54 stands still.

As described above, the preferred ECU 194 stores a plurality of control maps or equations related to various control routines. In order to determine appropriate control indexes in the maps or to calculate them using equations based upon the control indexes determined in the maps, various sensors are provided for sensing engine conditions and other environmental conditions.

With primarily reference to FIG. 1 and additionally reference to FIGS. 2 and 5, a throttle valve position sensor 280 is provided proximate the valve shaft assembly 112 to sense an opening degree or opening position of the throttle valves 110. A sensed signal is sent to the ECU 194 through a sensor signal line 282. Of course, the signals can be sent through hard-wired connections, emitter and detector pairs, infrared radiation, radio waves or the like. The type of signal and the type of connection can be varied between sensors or the same type can be used with all sensors. The sensed signal also can be used to determine a rate of change of the throttle valve position.

Associated with the crankshaft 86 is a crankshaft angle position sensor 284 which, when measuring crankshaft angle versus time, outputs a crankshaft rotational speed signal or engine speed signal that is sent to the ECU 194 through a sensor signal line 286, for example. The sensor 284 preferably comprises a pulsar coil positioned adjacent to the crankshaft 86 and a projection or cut formed on the crankshaft 86. The pulsar coil generates a pulse when the projection or cut passes proximate the pulsar coil. The sensor 284 thus can sense not only a specific crankshaft angle but also a rotational speed of the crankshaft 86. Of course, other types of speed sensors also can be used.

An air intake pressure sensor 290 is positioned along one of the intake passages 94, preferably at the uppermost intake passage 94, at a location downstream of the throttle valve 110. The intake pressure sensor 290 primarily senses the intake pressure in this passages 94 during engine operation. The sensed signal is sent to the ECU 194 through a sensor signal line 292, for example. This signal can be used for determining engine load. In the illustrated arrangement, the sensor 290 also senses air pressure before the engine 54 starts. The sensed pressure can be a fairly accurate proxy for the atmospheric air pressure.

A water temperature sensor 294 at the water jacket 204 sends a cooling water temperature signal to the ECU 194 through a sensor signal line 296, for example. This signal represents engine temperature.

An oxygen ($O_2$) sensor 298 senses oxygen density in exhaust gases. The sensed signal is transmitted to the ECU 194 through a sensor signal line 300, for example. The signal represents air/fuel ratio and helps determine how complete combustion is within the combustion chambers.

The lubrication system has a lubricant temperature sensor 302 and a lubricant pressure sensor 304 at the lubricant supply line 232. The sensed signals are sent to the ECU 194 through a sensor signal line 306 and a sensor signal line 308, respectively, for example.

A shift position sensor 310 sends a signal indicating a position of the shift rod 254 (forward, neutral or reverse) to the ECU 194 through a sensor signal line 312, for example. A lever operational speed sensor (not shown) senses a rotational speed of the shift lever (not shown) and its signal is sent to the ECU 214 through a sensor signal line (not shown), for example. Of course, other suitable techniques for sensing transmission position and movement can be used.

With reference now to FIGS. 1 and 4–6, control of the fuel injection system 154 and the ISC valve 402 by the ECU 194 will now be described. Other controls and operations, which can be simultaneously practiced, will be omitted in this description. In addition, it should be recognized that the control routines can be stored as software and executed by a general purpose controller, can be hardwired, or can be executed by a devoted controller.

Figure 3A:
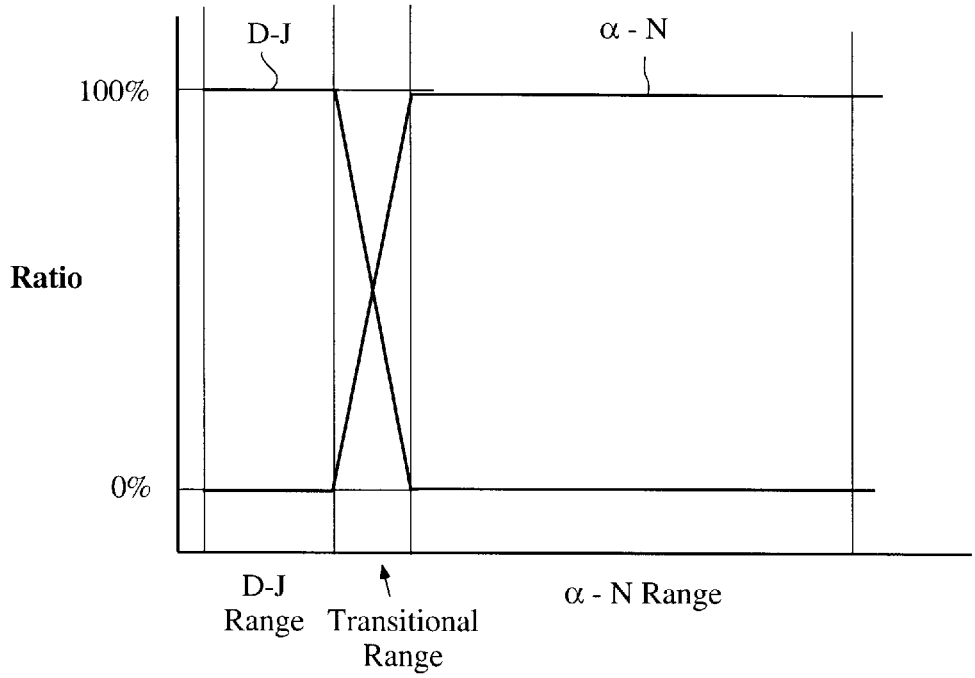
FIGS. 3(*a*) and 3(*b*) graphically illustrate a fuel injection control scheme and the ISC scheme respectively, which schemes have certain features, aspects and advantages in accordance with the present invention.
Figure 3B:
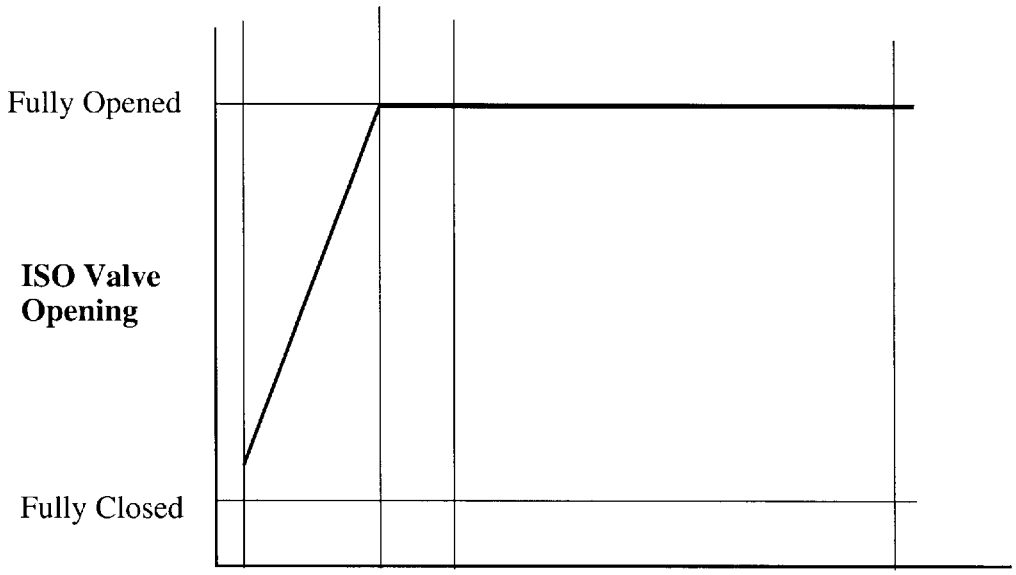
Figure 4:
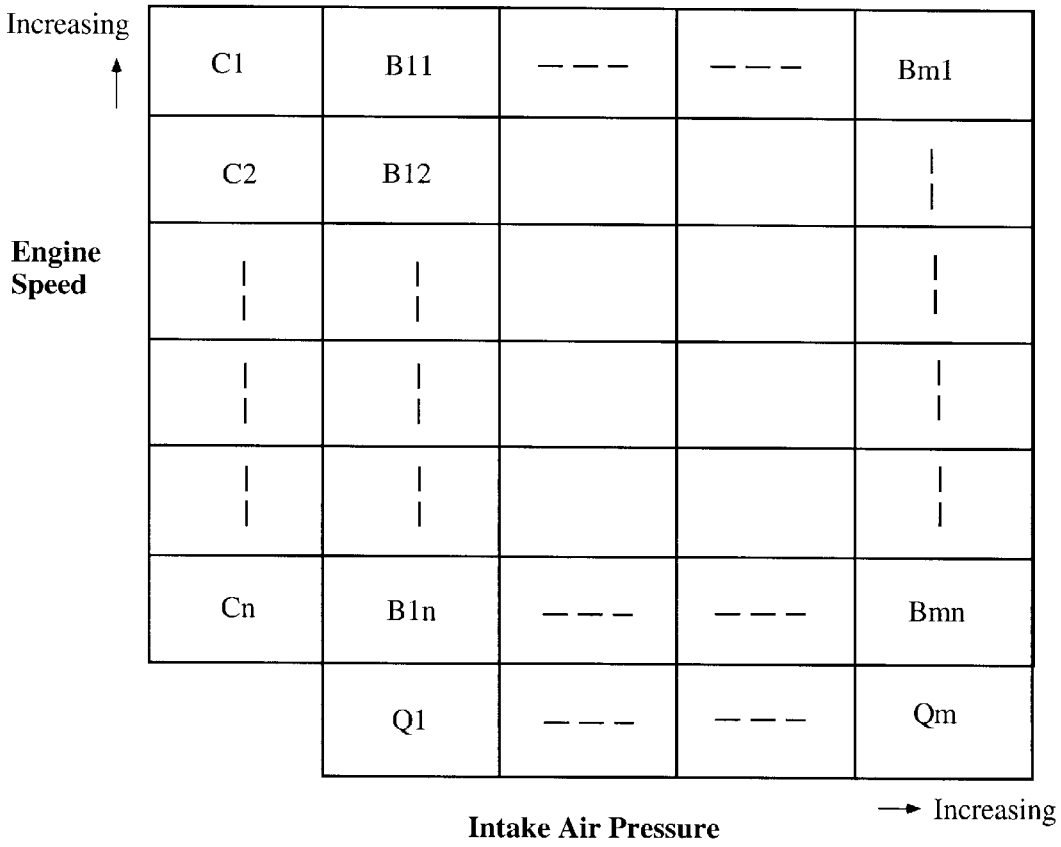
FIG. 4 is an exemplary fuel injection control map for smaller throttle valve angles.

With reference now to FIG. 3(*a*), FIG. 4 and FIG. 5, graphical illustration of the fuel injection amount calculation is presented. In the arrangement depicted in FIG. 3(*a*), three ranges are defined: a first range (D–J), a second range (transition) and a third range (α–N). To determine the fuel injection amount in each range the control maps depicted in FIGS. 4–5 are consulted.

The first range (D–J) corresponds to relatively small throttle angles. Although other control schemes are available, one control scheme that could be used is a D-Jetronic control scheme. In this scheme, two variables such as intake air pressure and engine speed are sensed. Once the value of these parameters is known, a control map is used to determine a fuel injection amount. For this control scheme, fuel injection amount is determined by first sensing intake pressure using intake pressure sensor 290 and engine speed using the angle position sensor 284. Then, a control map, such as that shown in FIG. 4, is consulted for a fuel injection amount (Bmn) corresponding to those conditions. Other control systems, such as a K-Jetronic, could also be used in the first control range.

The third range (α–N) corresponds to relatively large throttle angles. Two variables, such as engine speed and throttle angle, are sensed and a control map is used to determine an appropriate fuel injection amount. Although an engine speed-throttle position control scheme is preferred in the third range other schemes are possible. It is preferred, however, that at least one of the variables be different in the control schemes used in the first range and the third range. To determine an appropriate fuel injection amount, engine speed is sensed using the angle position sensor 284 and throttle angle is sensed using the throttle opening sensor 280. Then a control map, such as that shown in FIG. 5, is consulted for a fuel injection amount (Amn) for those conditions. Other control schemes can be used for the third range.

In the second range, which corresponds to throttle angles between the first and third ranges, fuel injection amount is calculated by sensing intake pressure, throttle angle position and engine speed, determining fuel injection amounts (Amn) and (Bmn), such as from maps similar to FIGS. 5 and 4 respectively, and then scaling each fuel injection amount according to a formula such as that depicted in the graph of FIG. 3(*a*). That formula reduces the contribution of fuel injection amount (Bmn) from 100% contribution at the highest throttle angle position in the D–J or first range to 0% contribution at the lowest throttle angle position in the α–N or second range. At the same time, the formula increases the contribution of fuel injection amount (Amn) from 0% contribution at the highest throttle angle position in the D–J or first range to 100% contribution at the lowest throttle angle position in the α–N or second range.

With reference now to FIG. 3(*b*), a graphical illustration of the ISC valve opening percentage relative to the throttle angle is presented. As illustrated in this exemplary embodiment, the ISC valve preferably is controllably opened as the throttle valve is opened. In other words, while the throttle angle is opened from a closed position to a wide open position, the ISC valve is similarly opening during a first preset range of throttle movement. After that amount of opening, the ISC valve becomes fixed at a preset angular opening. Advantageously, this allows the ISC valve to open during just a slight advancement of the throttle angle. In one preferred configuration, the ISC valve maintains a steady opening rate while the throttle angle is opened from about 1° to about 6°. After about 6° of throttle angle, however, the opening of the ISC valve becomes constant and is not opened or closed for greater throttle angles. Thus, the opening of the ISC valve advantageously is controlled based upon the positioning of the throttle valve.

Figure 6:
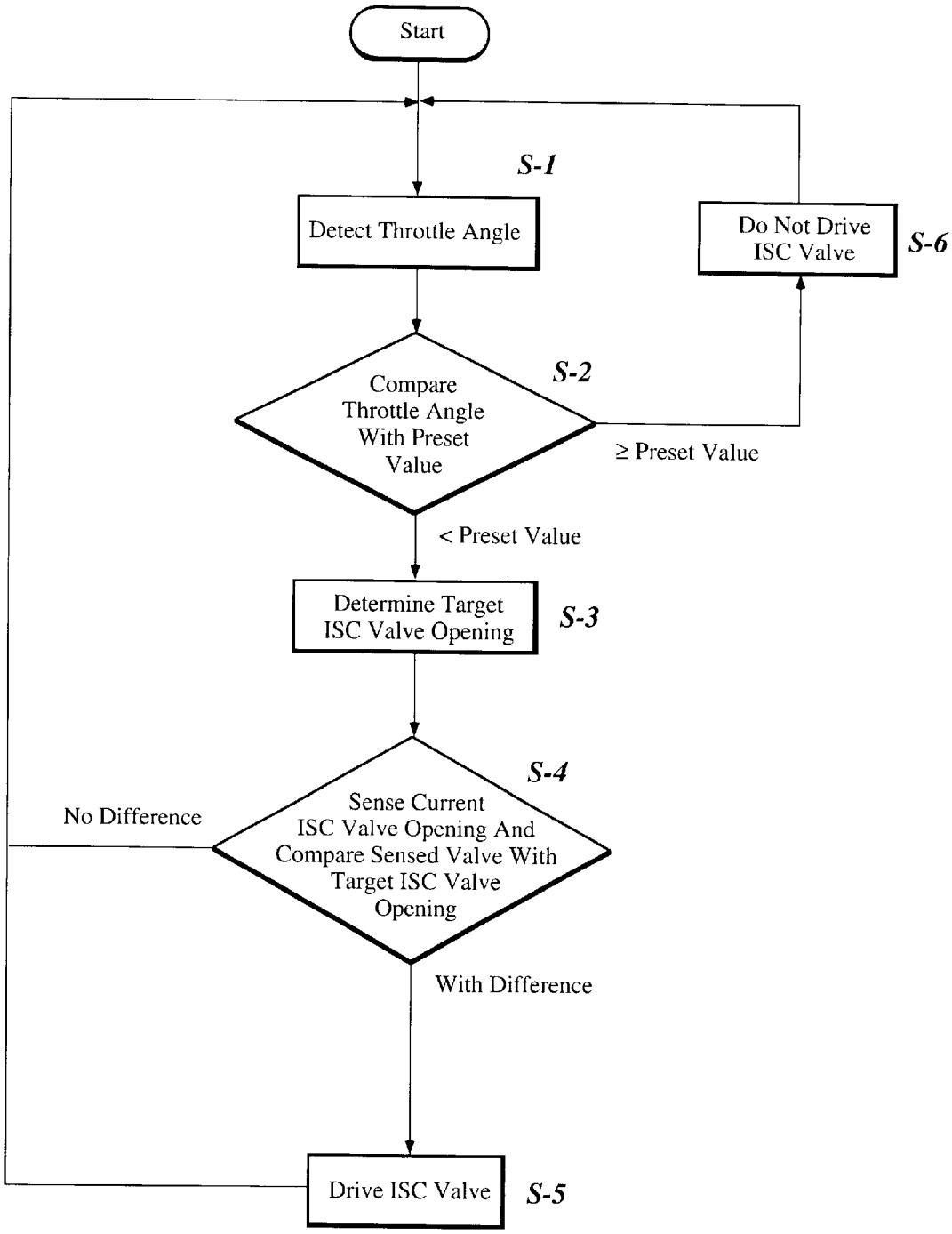
FIG. 6 is an exemplary routine used to employ certain features, aspects and advantages of the present invention, such as those depicted in FIGS. 3(*a*) and 3(*b*).

With reference now to FIG. 6, a control routine that is capable of implementing a control strategy that achieves control similar to that described graphically in FIG. 3(*b*) is illustrated therein. With reference now to FIG. 6, the routine begins by detecting a throttle angle (see S-1). After the throttle angle has been detected, the throttle angle is compared to a preset value, which could be about 6° (see S-2). If the throttle angle is greater than or equal to about the preset value, which could be about 6°, the ISC valve is not moved and the control routine returns to start (see S-6). If the throttle angle less than about the preset value, a target value of the ISC valve opening is determined (see S-3). This determination is based upon the throttle angle which has been previously detected in the illustrated arrangement. In particular, the target value of the ISC valve opening can be chosen based upon a preprogrammed control map in which the ISC valve opening is related to the throttle angle.

After determining the target value of the ISC valve opening, the target value is compared with the currently sensed value of the ISC valve position (see S-4). If the target value and the current value are the same, then the routine begins again by detecting the throttle angle. However, if the target value is different from the current value, the ISC valve is moved (see S-5) and the routine begins again by detecting the throttle angle.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Some of the steps of the illustrated control routine can be combined, split or otherwise manipulated. Additionally, some of the steps can be reordered in manners that will be apparent to those of ordinary skill in the art. Furthermore, the overall routine could be completed using several subroutines in a combined manner, for instance. Accordingly, the scope of the present invention is intended to be defined only by the claims that follow.

What is claimed is:

1. A marine internal combustion engine comprising a cylinder block defining a cylinder bore, a cylinder head assembly fixed at one end of said cylinder block enclosing one end of said cylinder bore, a piston that reciprocates in the cylinder bore, a connecting rod pivotally connected to said piston, a crankshaft rotatably journaled and driven by said piston through said connecting rod, said piston, said cylinder bore and said cylinder head forming a combustion chamber, at least one air intake passage being at least partially defined in said cylinder head, a plenum chamber in fluid communication with said air intake passage, an intake valve positioned between said air intake passage and said combustion chamber, a throttle valve pivotally mounted in said air intake passage between said plenum chamber and said cylinder head assembly, a fuel injector mounted to inject fuel toward said combustion chamber, a bypass passage in fluid communication with said plenum chamber and in fluid communication with said air intake passage downstream of said throttle valve, an ISC valve positioned along said bypass passage, an engine speed sensor positioned to detect a speed of said crankshaft, an actuator connected to said ISC valve, an intake pressure sensor positioned along said intake passage between said throttle valve and said intake valve, a throttle position sensor adapted to detect a position of said throttle valve, an ECU electrically connected with said engine speed sensor, said intake pressure sensor and said throttle position sensor, said ECU adapted to control a fuel injection amount in response to a first set of engine running conditions, and said ECU signaling said actuator to substantially fix said ISC valve in an open position over a range of values of a second engine running condition, above a preset value of the second engine running condition.

2. A marine internal combustion engine as set forth in claim 1, wherein the first set of engine running conditions comprises intake air pressure.

3. A marine internal combustion engine as set forth in claim 1, wherein the first set of engine running conditions comprises throttle position.

4. A marine internal combustion engine as set forth in claim 1, wherein the first set of engine running conditions comprises engine speed.

5. A marine internal combustion engine as set forth in claim 1, wherein the first set of engine running conditions comprises throttle position, intake air pressure and engine speed.

6. A marine internal combustion engine as set forth in claim 5, wherein the second engine running condition comprises throttle position.

7. A marine internal combustion engine comprising a cylinder block defining a cylinder bore, a cylinder head assembly fixed at one end of said cylinder block enclosing one end of said cylinder bore, a piston that reciprocates in the cylinder bore, a connecting rod pivotally connected to said piston, a crankshaft rotatably journaled and driven by said piston through said connecting rod, said piston, said cylinder bore and said cylinder head forming a combustion chamber, at least one air intake passage being at least partially defined in said cylinder head, a plenum chamber in fluid communication with said air intake passage, an intake valve positioned between said air intake passage and said combustion chamber, a throttle valve pivotally mounted in said air intake passage between said plenum chamber and said cylinder head assembly, a bypass passage in fluid communication with said plenum chamber and in fluid communication with said air intake passage downstream of said throttle valve, an ISC valve positioned along said bypass passage, an actuator connected to said ISC valve, a throttle position sensor adapted to detect a position of said throttle valve, an ECU electrically connected with said throttle position sensor, said ECU responsive to said throttle position sensor to signal said actuator to substantially fix said ISC valve in an open position over a range of said position of said throttle valve, equal to or above about 6°.

8. A marine internal combustion engine as set forth in claim 7, wherein said ECU is responsive to said throttle position sensor to signal said actuator to substantially fix said ISC valve in an open position over a range of said position of said throttle valve above about 9°.

9. A marine internal combustion engine as set forth in claim 1, wherein the fuel injector is positioned so that fuel in injected directly into said combustion chamber.

10. A marine internal combustion engine comprising a cylinder block defining a cylinder bore, a cylinder head assembly fixed at one end of said cylinder block enclosing one end of said cylinder bore, a piston that reciprocates in the cylinder bore, a connecting rod pivotally connected to said piston, a crankshaft rotatably journaled and driven by said piston through said connecting rod, said piston, said cylinder bore and said cylinder head forming a combustion chamber, at least one air intake passage being at least partially defined in said cylinder head, a plenum chamber in fluid communication with said air intake passage, an intake valve providing for fluid communication between said air intake passage and said combustion chamber, a throttle valve pivotally mounted in said air intake passage between said plenum chamber and said cylinder head assembly, a fuel injector for injecting fuel into said air intake passage downstream of said throttle valve, a bypass passage in fluid communication with said plenum chamber and in fluid communication with said air intake passage downstream of said throttle valve, an ISC valve pivotally mounted in said bypass passage, an angle position sensor juxtaposed with said crankshaft, a intake pressure sensor in said intake passage between said throttle valve and said intake valve, a throttle position sensor juxtaposed with said throttle valve, means for determining a fuel injection amount, means for controlling said ISC valve based on at least one engine running condition, said means substantially fixing said ISC valve in an open position over a range of values of said at least one engine running condition, above a preset value of the engine running condition.

11. A method of controlling fuel injection and intake airflow in a fuel injected internal combustion engine, the method comprising sensing a throttle angle, adjustably controlling a bypass airflow if said sensed throttle angle is less than a first preset throttle angle, and fixing a bypass passage airflow if said sensed throttle angle is greater than said preset throttle angle, controlling a fuel injection amount according to a first map if said sensed throttle angle is less than said preset throttle angle, and controlling a fuel injection amount according to a second map if said sensed throttle angle is more than a second preset throttle angle.

12. A method of controlling fuel injection and intake airflow in a fuel injected internal combustion engine, the method comprising sensing a throttle angle, adjustably controlling a bypass airflow if said sensed throttle angle is less than a first preset throttle angle, and fixing a bypass passage airflow if said sensed throttle angle is greater than said preset throttle angle, controlling a fuel injection amount according to a first map if said sensed throttle angle is less than said preset throttle angle and controlling a fuel injection amount according to a second map if said sensed throttle angle is more than a second preset throttle angle where said second preset throttle angle is greater than said first preset throttle angle.

13. A method of controlling fuel injection and intake airflow in a fuel injected internal combustion engine, the method comprising sensing a throttle angle, adjustably controlling a bypass airflow if said sensed throttle angle is less than a first preset throttle angle, and fixing a bypass passage airflow if said sensed throttle angle is greater than said preset throttle angle, controlling a fuel injection amount according to a first map if said sensed throttle angle is less than said preset throttle angle, controlling a fuel injection amount according to a second map if said sensed throttle angle is more than a second preset throttle angle where said second preset throttle angle is greater than said first preset throttle angle, and controlling a fuel injection amount according to both said first and said second control maps where said sensed throttle angle is between said first preset throttle angle and said second preset throttle angle.

14. A method of controlling fuel injection and intake airflow in a fuel injected internal combustion engine, the method comprising sensing a throttle angle, adjustably controlling a bypass airflow if said sensed throttle angle is less than a first preset throttle angle, and fixing a bypass passage airflow if said sensed throttle angle is greater than said preset throttle angle, scaling said fuel injection amount recommended by said first control map in a linear fashion from one hundred percent at said first preset throttle angle to zero percent at said second preset throttle angle, and scaling said fuel injection amount recommended by said second control map in a linear fashion from zero percent at said first preset throttle angle to one hundred percent at said second preset throttle angle.

15. A method of controlling fuel injection and intake airflow in a fuel injected internal combustion engine, the method comprising controlling with a first control strategy below a first preset throttle angle, controlling with a second control strategy above a second preset throttle angle, transitioning between said first and said second control strategies between said first preset throttle angle and said second preset throttle angle, and fixing an ISC valve in an open position before transitioning at said first preset throttle angle.

16. A method of controlling fuel injection and intake airflow in a fuel injected internal combustion engine, the method comprising controlling at least partially based on a first control strategy below a first preset throttle angle, controlling at least partially based on a second control strategy above a second preset throttle angle, fixing an ISC valve in an open position before controlling at least partially based on said second control strategy.

17. An internal combustion engine comprising a cylinder block defining a cylinder bore, a cylinder head assembly fixed at one end of said cylinder block enclosing one end of said cylinder bore, a piston that reciprocates in the cylinder bore, a connecting rod pivotally connected to said piston, a crankshaft rotatably journaled and driven by said piston through said connecting rod, said piston, said cylinder bore and said cylinder head forming a combustion chamber, at least one air intake passage being at least partially defined in said cylinder head, a plenum chamber in fluid communication with said air intake passage, an intake valve positioned between said air intake passage and said combustion chamber, a throttle valve pivotally mounted in said air intake passage between said plenum chamber and said cylinder head assembly, a fuel injector mounted to inject fuel toward said combustion chamber, a bypass passage in fluid communication with said plenum chamber and in fluid communication with said air intake passage downstream of said throttle valve, an ISC valve positioned along said bypass passage, an engine speed sensor positioned to detect a speed of said crankshaft, an actuator connected to said ISC valve, an intake pressure sensor positioned along said intake passage between said throttle valve and said intake valve, a throttle position sensor adapted to detect a position of said throttle valve, an ECU electrically connected with said engine speed sensor, said intake pressure sensor and said throttle position sensor, said ECU adapted to control a fuel injection amount in response to a first set of engine running conditions, and said ECU signaling said actuator to substantially fix said ISC valve in an open position over a range of values of a second engine running condition, above a preset value of the second engine running condition.

* * * * *